United States Patent [19]

Glunz et al.

[11] Patent Number: 5,003,889

[45] Date of Patent: Apr. 2, 1991

[54] ROTARY PRINTING MACHINE SYSTEM WITH A WEB PATH CHANGING ARRANGEMENT

[75] Inventors: Wolfgang Glunz, Augsburg; Gunnar Rau, Königsbrunn, both of Fed. Rep. of Germany

[73] Assignee: MAN Roland Druckmaschinen AG, Offenbach am Main, Fed. Rep. of Germany

[21] Appl. No.: 475,125

[22] Filed: Feb. 5, 1990

[30] Foreign Application Priority Data

Feb. 22, 1989 [DE] Fed. Rep. of Germany ..... 3905400

[51] Int. Cl.[5] ..... B41F 13/02

[52] U.S. Cl. ..... 101/228; 101/180; 226/199

[58] Field of Search ..... 101/180, 181, 228, 219, 101/138, 139, 143; 226/199

[56] References Cited

U.S. PATENT DOCUMENTS

| | | | |
|---|---|---|---|
| 4,325,301 | 4/1982 | Grosshauser | 101/228 X |
| 4,393,772 | 7/1983 | Burger | 101/228 X |
| 4,401,028 | 8/1983 | Kobler et al. | 101/228 X |
| 4,412,490 | 11/1983 | Grosshauser | 101/219 |

FOREIGN PATENT DOCUMENTS

| | | | |
|---|---|---|---|
| 2741596 | 3/1978 | Fed. Rep. of Germany | 101/228 |
| 2932087 | 10/1985 | Fed. Rep. of Germany . | |

OTHER PUBLICATIONS

"Rollenoffset" (Rotary Offset) Printing by Oskar FREI, Frankfurt am Main, 1979, p. 35.

*Primary Examiner*—Clifford D. Crowder

*Attorney, Agent, or Firm*—Frishauf, Holtz, Goodman & Woodward

[57] ABSTRACT

To provide access to sequentially positioned printing machine operating stations (3, 14, 17, 33, 44) without having to tear a paper web threaded through the printing machine, in which the web passes, when in a printing position, essentially horizontally between the operating stations, a pair of vertically spaced substrate guide elements (23, 26; 123, 126; 56) are positioned on a vertical elevator positioning structure (22, 122; 52), the paper being guided between the guide elements, and the positioning structure permitting movement of the guide elements from an essentially central printing position to an upper position (**23*b*) and a lower position (23*a***). The paper, before being passed between the substrate guide elements, is passed through a paper storage structure, for example by spaced, deflectable rollers which store paper in loop form, from which it can be released. The upper one of the guide elements is strong enough for an operator to stand thereon. When the guide elements are in their upper or lower position, respectively, an operator has access to the lower and upper operating elements of the respective adjacent operating station.

9 Claims, 7 Drawing Sheets

ROTARY PRINTING MACHINE SYSTEM WITH A WEB PATH CHANGING ARRANGEMENT

FIELD OF THE INVENTION

The present invention relates to rotary printing machines, and more particularly to large web-fed rotary offset printing machines, for example for newspaper and similar printing, in which the paper path can be changed, selectively, so that operators may have access to cylinders of the printing machine systems or printing units, without having to cut the paper web, by changing the paper path through the printing machine.

BACKGROUND

German Patent Disclosure Document DE-OS 27 41 596 describes a printing machine system, particularly for newspaper printing, in which the paper web is passed through a printing unit in essentially vertical direction. The path of the substrate web can be changed, so that regions of the machine which, in operation, are covered by the substrate web, can be made accessible, for example for maintenance work on the elements of the printing machine. The paper web is guided over a pair of deflection rollers, independently of the position of a working platform and the operating state of the machine, by being looped in an essentially S-shaped path about the deflection rollers which are positioned beneath a vertically movable working platform. The working platform can even be moved during operation of the printing machine without changing the length of the substrate path within a height difference which is determined by the upper edge of an intermediate platform bottom through which the substrate is carried to the first deflection roller and an additional further deflection roller, located in advance of the printing unit and fixed in position. The paper web is passed from the fixed further deflection roller to the second deflection roller on the work platform. When the work platform is raised, the lower printing cylinders are accessible to operators and mechanics for cleaning, maintenance and the like. When the platform is lowered, operators and mechanics can step on the platform and have access to the upper components, cylinders and rollers of the printing machine.

Rotary printing machine systems having a plurality of printing units or printing stations which are constructed in row arrangement, through which the web passes in essentially horizontal direction, cannot use the system described in the above referenced Disclosure Document 27 41 596, since the height difference of the printing machine elements, which are a condition for maintenance and moving of the platform without changing the web length no longer is available. If an S-shaped loop in the web path about deflection rollers is arranged in sequential, row-type printing stations of a composite printing machine, interference with the printed subject matter would result since ink printed on a substrate would not have time to dry and, thus, smearing of the freshly printed subject matter on the substrate would result.

THE INVENTION

It is an object to provide an arrangement to change the path of a substrate web through a printing machine which provides for access to the elements, cylinders and rollers of printing machine units which are located next to each other so that the overall printing machine system is one in which the units are sequentially arranged, with the normal web path being essentially horizontal. Easy access to all the cylinders, for example for cleaning, maintenance, replacement of printing plates, or other work thereon, should be provided.

Briefly, the arrangement to change the paper path includes a pair of vertically spaced substrate guide elements, for example in the form of sheet steel or flat guide funnels. The pair of guide elements are movable between a printing position in which the substrate web passes contactless between the guide elements, an upper position suitable for maintenance of lower components of the printing machine unit, and a lower position suitable for access to upper components of the printing machine units. The upper one of the vertically spaced substrate or web guide elements is constructed to have sufficient strength to form a platform to support an operator and permit an operator to stand thereon when the substrate guide elements are in their lower position, thus providing access for the operator to the upper region of the printing station. Access to the lower region of the printing station is provided when the substrate guide elements are moved upwardly. A web storage arrangement is placed in advance of the web path changing arrangement to provide a substrate web length during displacement of the guide elements from the printing position so that the integrity of the web need not be interfered with, and time-consuming rethreading of a multiple printing machine system is not required.

DRAWINGS

DETAILED DESCRIPTION

Figure 1:
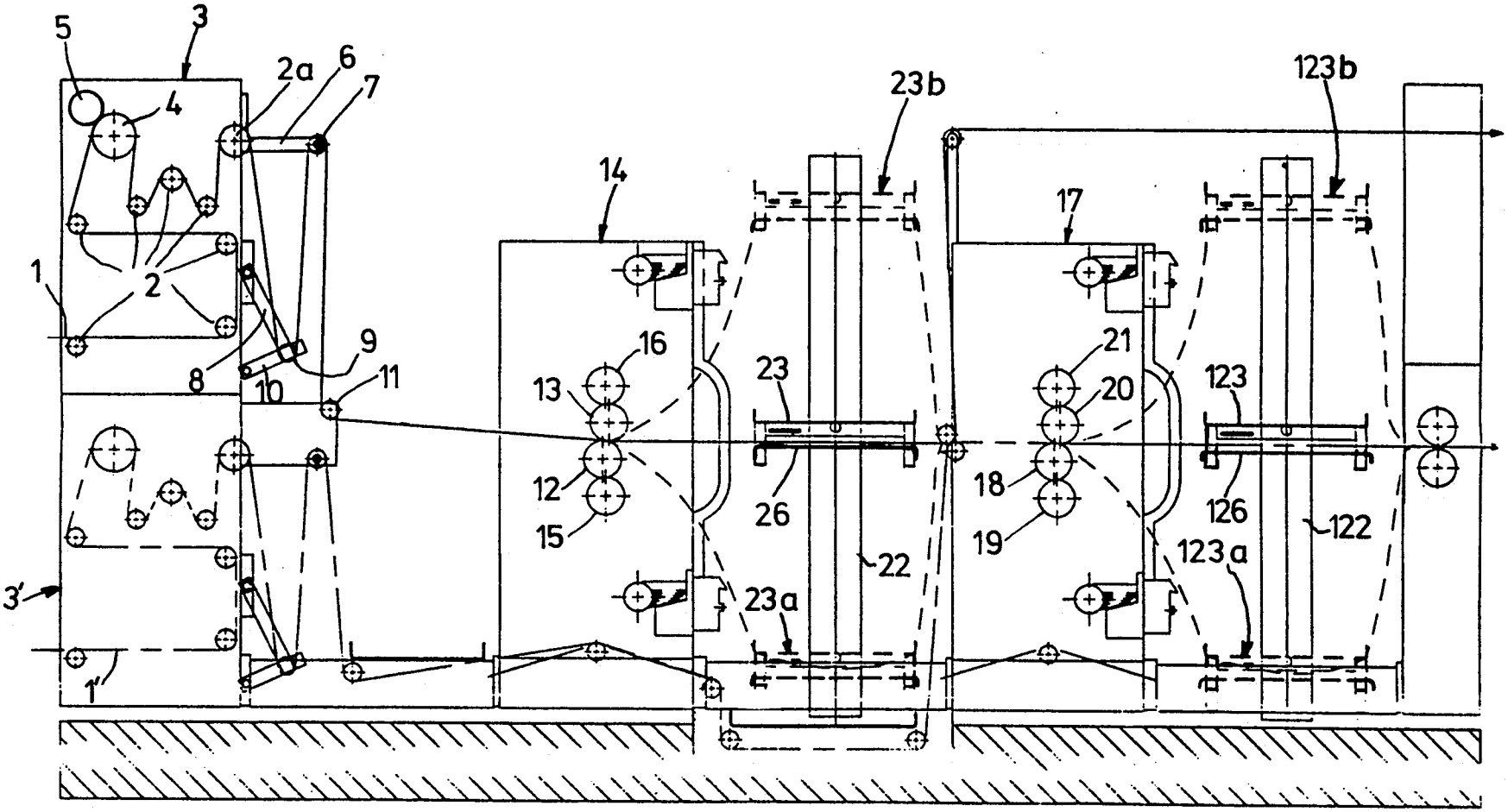
FIG. 1 is a highly schematic side view of a printing machine system showing the in-feed unit, and two printing stations or units, and, highly schematically, the arrangement to change the position of the substrate web in accordance with the present invention.

A substrate web 1, for example a paper web, is delivered from a suitable delivery apparatus to an inlet and transport unit 3, which includes a plurality of deflection rollers 2. The inlet and transport unit 3 has a driven transport roller 4 against which the substrate web 1 is engaged by a pressure roller 5. Web 1 is looped over a portion of the transport roller 4. The driven transport roller 4, in combination with the pressure roller 5, provides the necessary drive for the web 1. Suitable additional deflection rollers form part of the inlet and transport unit 1, the last one of which is shown at 2a. A laterally extending support element 6 extends sideways at approximately the level of the last deflection roller 2a. A further roller 7 is located at the end of the support element 6.

The further roller 7, in combination with a vertically movable roller 9, forms a web storage system. A pivot lever 8 is pivotably secured to the side wall of the inlet and transport unit 3. The outer end of the roller 8 carries a roller 9. The roller 8 is shown at its lower position in FIG. 1, in which it can be locked by a suitable locking lever 10. The pivot lever 8 can be moved by a power moving arrangement, preferably a pneumatic arrangement, after unlocking of the locking lever 10, by about 150° to an upper end position, see lever 38 of FIG. 3.

In operation, the web 1 is guided first to the deflection rollers 2, then to the transport roller 4, then to further deflection rollers 2 and over roller 2a downwardly to roller 9 and then again upwardly to the roller 7. The roller 9, in operation, forms a loop between the roller 2a and roller 7 and, thus, provides a storage region for the web 1.

The web 1 is then guided from the roller 7 by a suitable further deflection roller 11 in such a direction that it runs in an essentially horizontal path between two rubber blanket cylinders 12 and 13 of a first printing unit or printing station 14. In the example of FIG. 1, the deflection roller 11 is necessary, positioned approximately at the level of the inlet or run-in nip between the blanket cylinders 12, 13 so that the difference in level between the deflection roller 7 and the inlet nip can be compensated. In accordance with FIG. 1, this level difference occurs because the printing machine can handle two webs. The inlet system 3 has a similar arrangement shown at 3', on which a web 1' can be guided and passed to or through the printing unit 14. The rollers as well as the storage arrangement are identical to those above described and, therefore, are not specifically labeled in FIG. 1, for clarity of the drawing.

The first printing station 14 has two essentially vertically located printing couples. The lower printing couple has a blanket cylinder 12, a plate cylinder 15, and suitable inkers and dampers, not shown, since they can be of any standard and well known construction. The upper printing couple is formed by the blanket cylinder 13, a plate cylinder 16 engageable therewith, and suitable inkers and dampers.

The web, after passing the nip between the blanket cylinders 12, 13, is then guided contact-free and, essentially horizontally, to a subsequent printing unit 17. The printing station 17 has two essentially vertically arranged printing couples, formed by a blanket cylinder 18 and plate cylinder 19, together with associated inkers and dampers, and the blanket cylinder 20 and plate cylinder 21, also supplied with the usual inkers and dampers.

In accordance with a feature of the invention, the gap or free space between the printing units 14 and 17 is wide enough so that a vertically located guide structure 22 can be placed therebetween.

In accordance with a preferred feature of the invention, the guide structure 22 is located only on one side of the printing machine, and, preferably, at the drive side, that is, that one of the sides which carries the gears and shafts necessary to rotate the various cylinders and accessory equipment units, e.g. inkers and dampers, of the printing stations. Thus, the space at the operator side will be freely accessible. Two substrate web guide elements 23, 26 of essentially plate-like construction and spaced vertically from each other to define a gap therebetween, are vertically movably secured to the guide structure 22. In accordance with a preferred embodiment, the two web guide elements, which form a pair, are coupled together so that they will move in unison. They extend essentially parallel to the longitudinal direction of the web 1. As shown in the example, they are constructed of flat sheet metal elements, the end regions of which are rounded off by bent zones. Other shapes, for example essentially semicircular sheet metal elements, or a plurality, for example two or more, rods or rollers extending transversely to the web 1, can be used.

The web guide elements 23, 26 are located vertically above each other to define a vertical space or gap so that, when they are in alignment with the nips between the blanket cylinders 12, 13 of printing station 14 and cylinders 18, 20 of printing station 17, the web will pass between the guide elements 23, 26 without contact. Thus, smearing of still wet ink, applied by the blanket cylinders 12, 13 is prevented.

Figure 6:
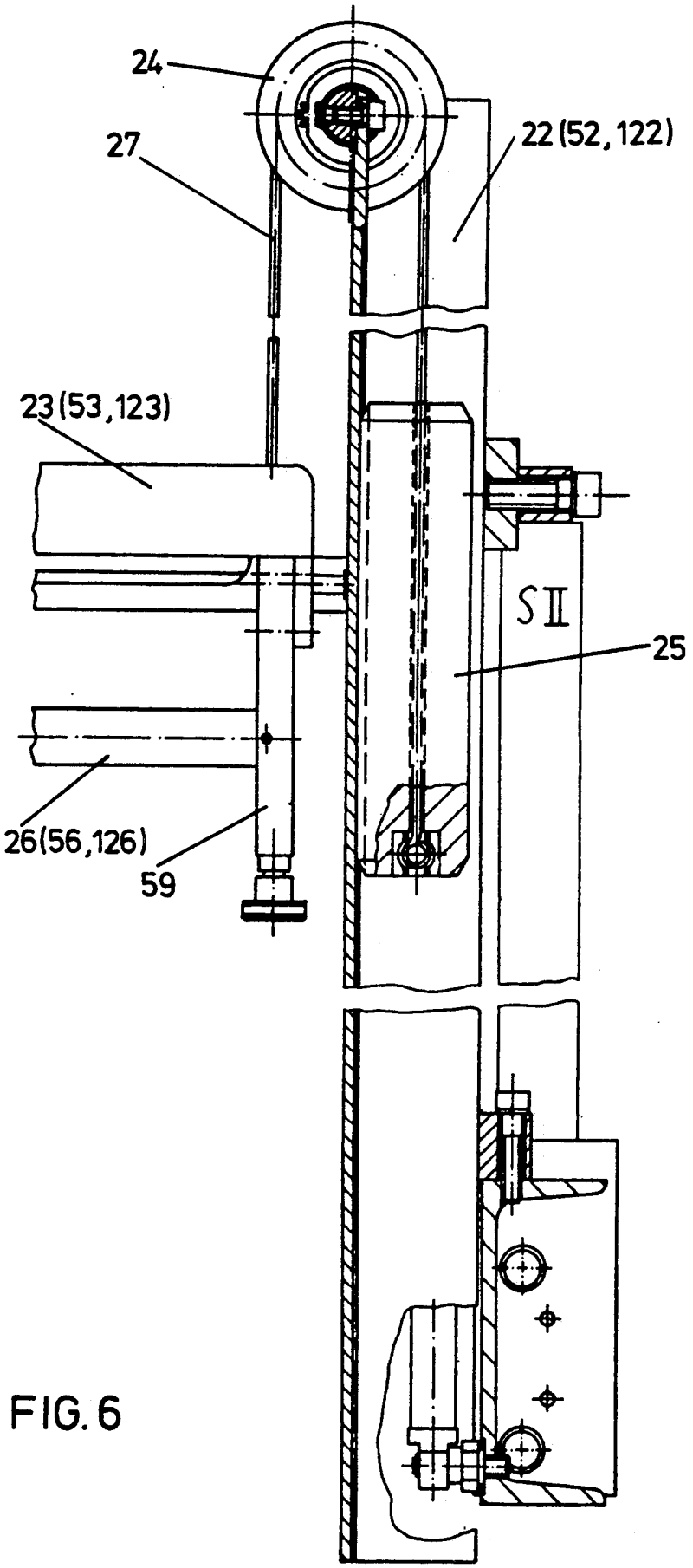
FIG. 6 is a schematic side view to an enlarged scale, illustrating one arrangement to shift the path of the web, and the guide components therefor.

The web guide element pairs 23, 26 can be locked in three positions on the guide structure 22. In a simple manner, the guide pairs 23, 26 are moved by hand, which is facilitated, as seen in FIG. 6, by carrying a cable about a deflection roller 24 at the upper portion of the guide structure 22, load it with a counter weight 25 which balances the weight of the guide elements 23, 26. Other, but more expensive ways can be used, for example a crank-gear-rack arrangement, an electric, pneumatic or hydraulic lifting system or the like.

When the printing machine prints on the web 1, the guide elements 23, 26 are in a central position, as shown in FIG. 1. In this position, the web 1 is guided without contact horizontally between the bottom side of the upper guide element 23 and the top side of the lower guide element 26. FIG. 1 shows not only this position, which is shown in full lines, but also, in broken lines, an upper and lower position.

In the lower position, identified with the reference numeral 23a, the upper web guide element 23 is supported, at least at the operating side of the printing machine, from the lower surface thereof as shown by support element 59 (FIG. 6). In accordance with a feature of the invention, the upper web guide element 23 is strong enough so that an operator can walk thereon. In this position, the web 1 is guided beneath the upper guide element 23. When the machine is stopped, thus, plate changes, maintenance and repairs can be carried out at the machine, and particularly at the upper printing couples and associated equipment of the printing stations 14 and 17, that is, for example, on the couples 13, 16 and 20, 21. Operators, for such maintenance, can stand on the upper guide element 23.

When the pair of web guide elements 23, 26 are moved to the upper position, shown at 23b in FIG. 1, the web 1 lies on the lower guide element 26. Again, the space between the printing units 14, 17 is readily accessible for retrofitting, maintenance or the like, providing access to the lower printing couples 12, 15 and 18, 19, and the associated equipment.

A further guide structure 122, together with web guide elements 123, 126, is located between the second printing unit 17 and a subsequent printing unit. The construction of the guide structure 122 and of the printing elements 123 and 126 is identical to that described in connection with the structure 22 and guide elements 23, 26. The second web guide elements 123, 126, preferably, are coupled together to form a pair and can be shifted, in unison, along the guide structure 122 from a central or printing position, shown in full lines, to a lower position 123*a* and an upper position 123*b*. In the lower position 123*a*, an operator can step on and stand on the upper web guide element 123 for maintenance of the back portion of the printing station 14 as well as on the front portion of the printing unit 17.

The web 1 can be deflected from its central or printing position, when the machine is stopped, by releasing stored web length, released from the web storage arrangement at the run-in part 3, by unlocking the lock or latch 10 and permitting the lever 8 to swing upwardly. As shown in the example of FIG. 1, web 1 is thereby released from the full-line position shown in FIG. 1 by permitting a shift of the roller 9 with respect to the fixed rollers 2*a* and 7. The following is necessary to carry this out: The blanket cylinders 12 and 13 are separated from each other, and the locking or latching lever 10 is unlocked. The lever 8 is then pivoted upwardly, thereby releasing the storage loop of the web formed thereby, and as shown in FIG. 1. As an additional feature, and to prevent possible tearing of the web, the pressure roller 5 can also be released from the tension roller 4, and the tension roller 4 uncoupled from its drive so that it can roll freely.

FIGS. 2–5 illustrate, to an enlarged scale and in greater detail, the arrangement by which the path of the substrate web can be changed, and the operation in accordance with various positions of the web.

Printing station 44 (FIGS. 2–5) is shown arranged for prime-and-verso printing. Web 31 is passed through the inlet or run-in unit 33 over a plurality of guide rollers, of which only guide rollers 32 are shown. The last one, guide roller 32*a*, guides the web to the storage arrangement. The run-in or first inlet unit 33, corresponding to the example shown in connection with FIG. 1, also has a transport roller and a pressure roller, not shown in FIG. 2, for clarity of the drawing. A horizontal brace or bracket, corresponding to element 6, extends in approximately horizontal alignment from the last deflection roller 32*a*, and carries a deflection roller 37 at its end.

Figure 2:
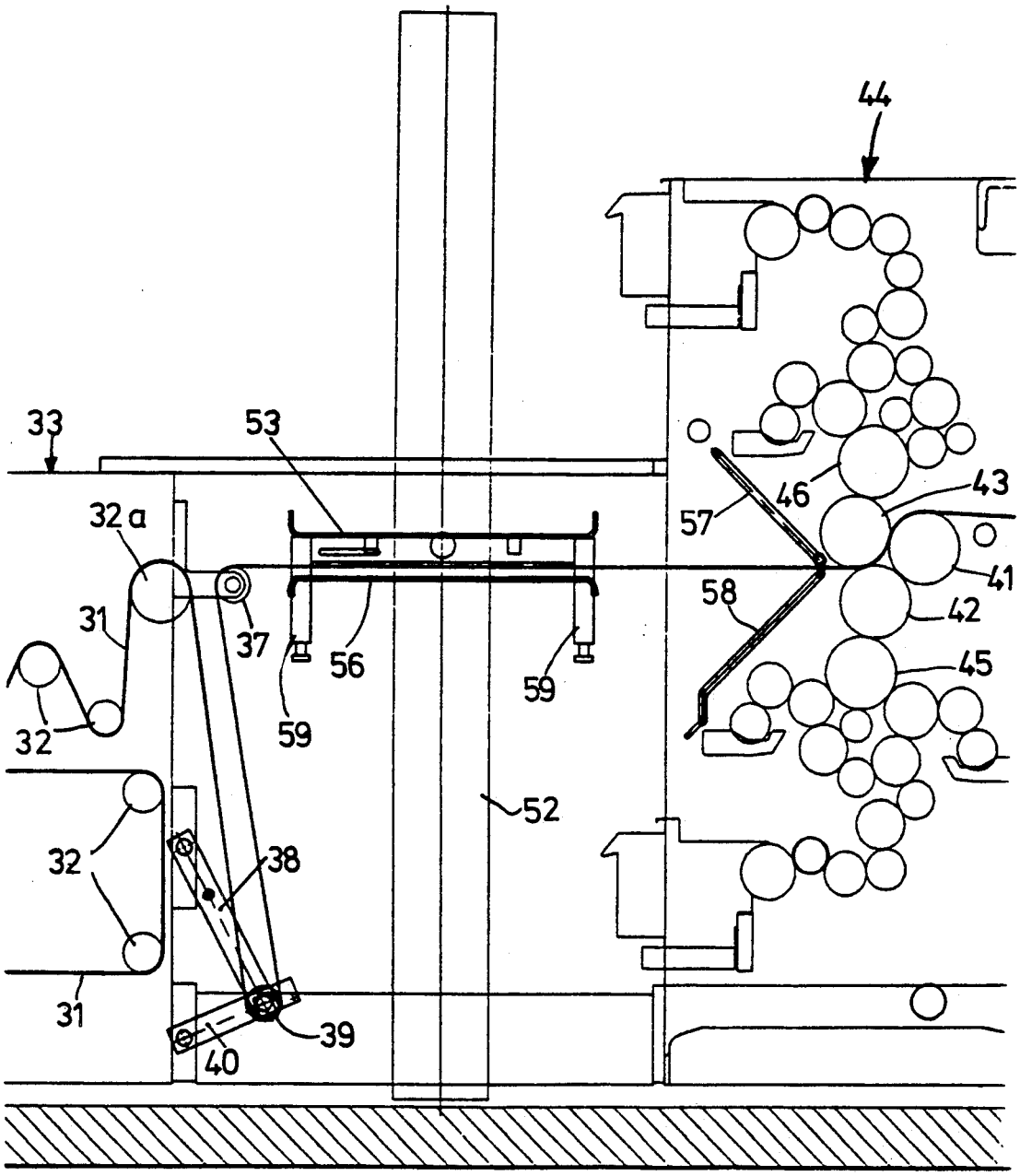
FIG. 2 is a schematic side view of the feed-in portion and a printing machine unit, arranged for prime-and-verso printing.

A lever 38 is pivotably secured to the side wall of the inlet unit 33. FIG. 2 illustrates the lever 38 in its lower end position, in which it can be secured by a suitable locking lever 40. The pivot lever 38, after unlocking of the locking lever 40, can be moved, preferably by a pneumatic displacement apparatus, by about 150° in an upper end position. This upper end position of the lever 38 is visible in FIGS. 3, 4 add 5. The locking lever 40 may, for example, merely be a lever element with a notch at the end engaging in a suitable projection or pin.

For printing, the web 31 is passed over the last deflection roller 32*a*, guided downwardly, is looped over the pivotably retained roller 39, and is then again guided over the deflection roller 37. The roller 39, secured to the pivot lever 38, forms a web loop, which functions as a storage loop when in the position shown in FIG. 2 and, hence, the elements 38, 39 between the rollers 32, 37 and in combination therewith, form a web storage arrangement.

The web 31 is so guided from the deflection roller 37 that it passes essentially horizontally to the inlet nip between two blanket cylinders 42, 43 of a first printing station 44. The printing station 44 has two, essentially vertically located printing units having blanket cylinders 42, 43, and engageable against a common impression cylinder 41. The lower printing unit is formed by a printing couple including blanket cylinder 42 and a plate cylinder 45 engageable therewith, as well as well as suitable inkers and dampers, shown only schematically, since they may be of any suitable construction. The upper printing unit is formed by the blanket cylinder 43 and a plate cylinder 46, engageable therewith, as well as inkers and dampers, shown only schematically.

In operation, the web 31, after passing the nip between the cylinders 42, 43, then passes over the impression cylinder 41 which, in this mode of operation, only forms a paper guide roller. It then passes, without contact and without touching any further components in an essentially horizontal path, to a further printing station, not shown in FIG. 2, for example similar to printing station 17 (FIG. 1).

A vertically positioned guide structure 52 is located in the space between the inlet unit 33 and the first printing station 44. It is preferably located at least approximately at the level of the side wall of the printing machine, and as above described, is located only on one side of the printing machine, namely at the drive side, so that the space between the inlet or run-in unit 33 and the first printing station 44 is freely accessible from the operator side of the machine.

Two web guide elements 53, 56 are longitudinally movable along the guide structure 52, which are identical to the elements 23, 26 above described, and hence need not further be described in detail.

In order to prevent accidents, grids or plates 57, 58 are located in advance of the nip of the cylinders 42, 43. These plates, screens, grates or fences 57, 58 extend towards the web 31 leaving, however, a small gap for free passage of the web.

Figure 3:
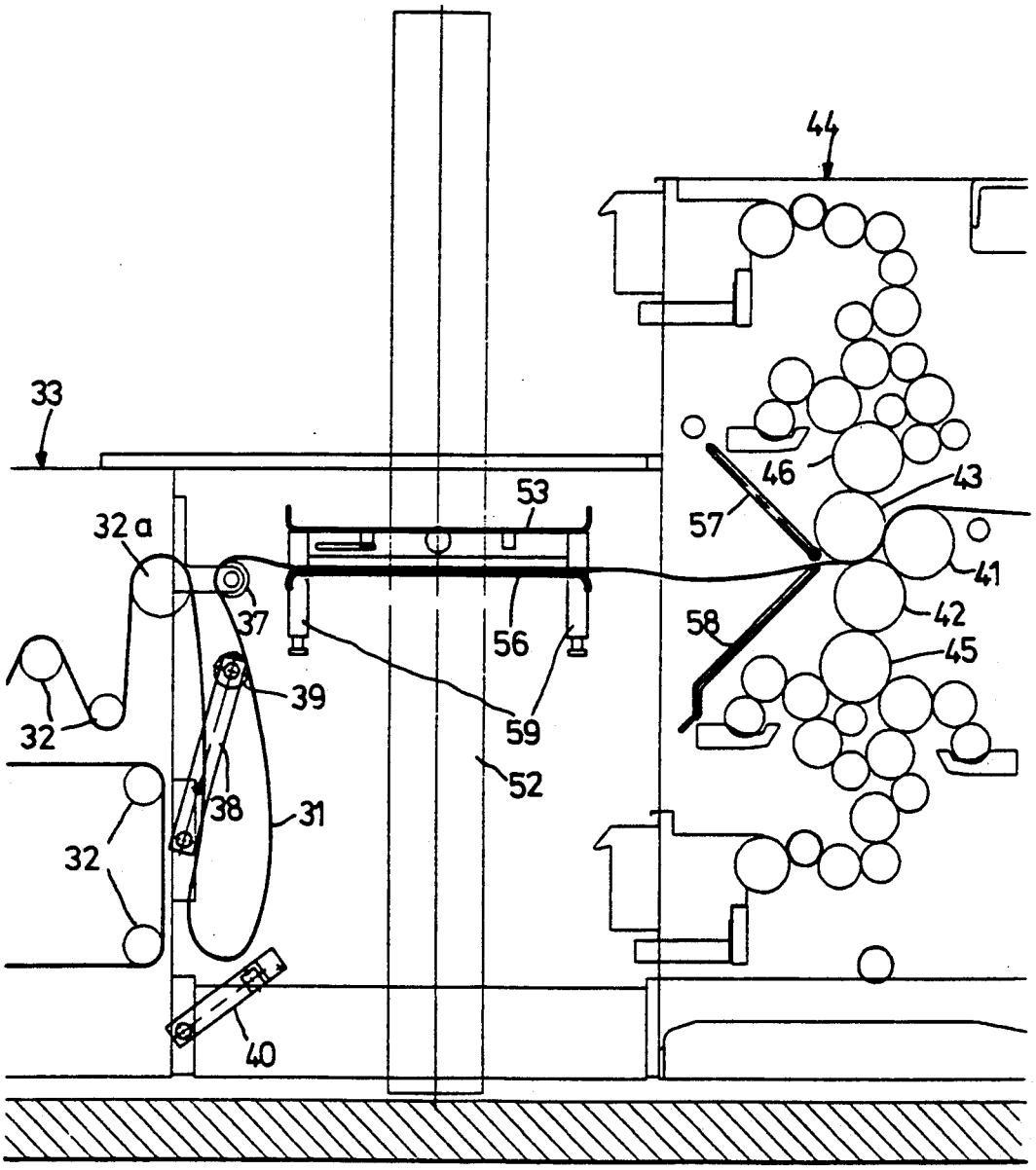
FIG. 3 illustrates the unit of FIG. 2 with the web storage arrangement in a position to supply extra substrate web length.
Figure 4:
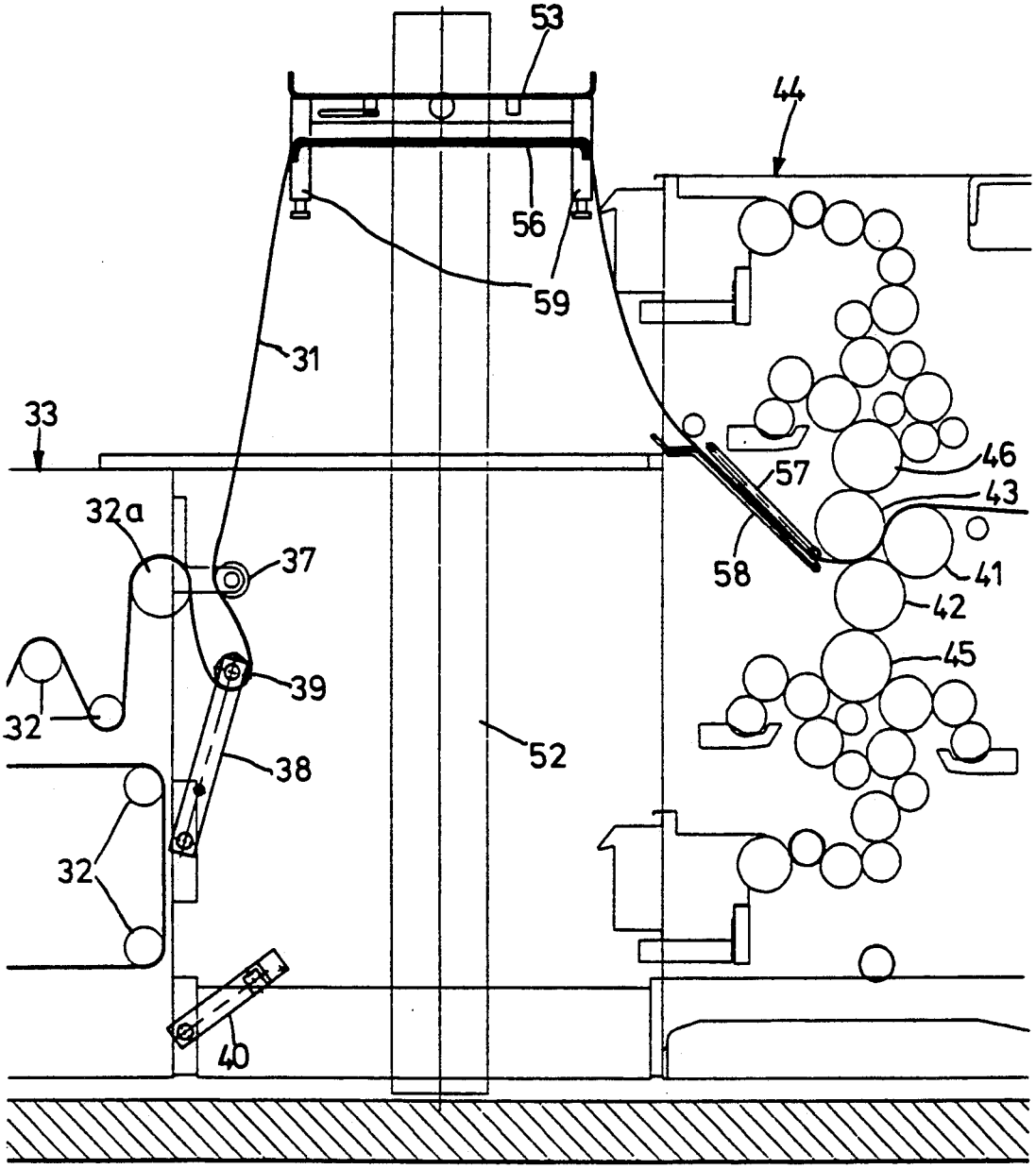
FIG. 4 shows the arrangement of FIG. 3, with the web guide elements in an upper position to permit access to lower portions of the printing machine unit.

As seen in FIG. 2, the web 31, using the printing station 44 for prime-and-verso printing, is guided without contact between the upper web guide element 53 and the lower web guide element 56, both of which are locked in place at the central or printing position. If, for example, the printing plate on plate cylinder 45 of the lower printing couple of station 44 is to be exchanged, the following sequence of steps can relocate the web 31, to provide easy access to the plate cylinder 45:

First, and as best seen in FIG. 3, the locking lever 40 is lifted and released, and the pivot lever 38 is pushed in its upper position, manually or, preferably, by a pneumatic positioning element. Such a positioning element has been omitted from the drawings, since any suitable construction may be used. The guide roller 39 thus releases the loop in the web 31 where, previously (FIG. 2), it had been held in a taut position. The web 31 now is without tension and will lie on the lower web guide element 56.

The loose web 56 now permits shift of the web guide elements 53, 56 along the guide structure 52 into an upper position, where it is locked in place. The web 31 is carried along by the lower web guide element 56, the loose loop released by the guide roller 39 permitting movement of the web guide pair 53, 56 to the upper position. The lower protective grid or fence 58 is pivoted upwardly. Free access to the blanket cylinder 42 and the plate cylinder 45 thus can be obtained.

Figure 5:
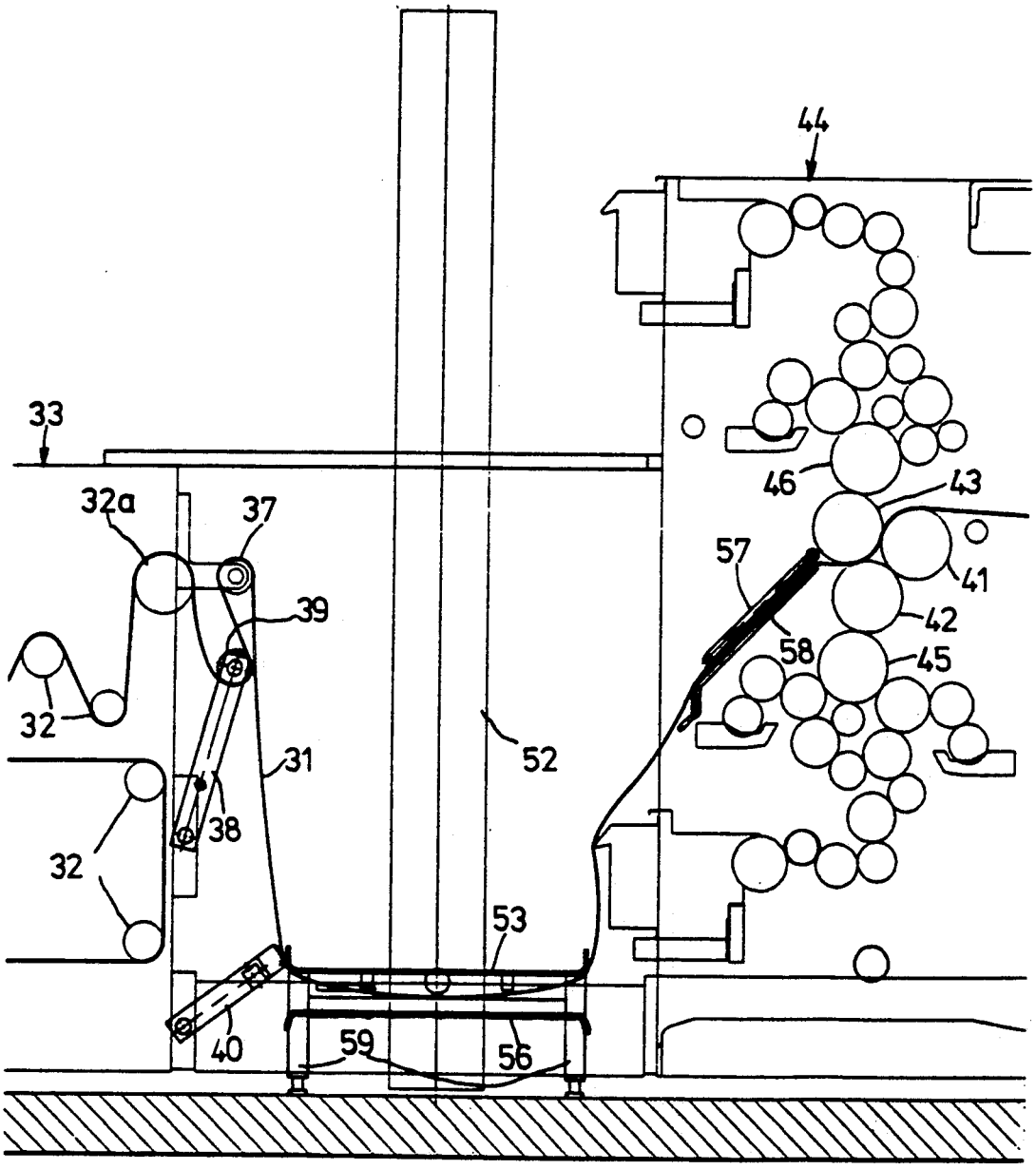
FIG. 5 shows the arrangement of FIG. 3, with the web guide elements in lowered position to permit access to the upper portions of the printing machine system.

If it is then desired to change the plate 46 of the upper printing couple 43, 46, and as seen in FIG. 5, the web guide elements 53, 56, with the web 31 still in loose, released position, are moved to the lower position and there locked in place. The upper web guide element 53 is supported, at least at the operator side, by support elements 59 on a longitudinal rail of the printing machine, or directly on its base. The upper web guide element is sufficiently strong to support an operator who, therefore, can step on and walk on the upper web guide element 53. Since the web 31 is beneath the web guide element 53, it is protected in this position. The upper protective fence 57 is pivoted downwardly, as seen in FIG. 5, thus providing free access to the upper printing unit including the printing couple 43, 46.

To then start printing, and to reestablish the printing position of FIG. 2, the previously described steps are carried out in reverse: The protective fences 57, 58, respectively, are relocated in their protective position by flipping them back in place, as seen in FIG. 2; the guide elements 53, 56 are moved into the central position, pivot lever 38 is moved downwardly, and locked in place by locking lever 40. Of course, if as an additional safety feature, the pressure roller 5 had been disengaged from the transport roller 4 (FIG. 1), and drive of the transport roller 4 uncoupled, which is desirable in any event when repositioning the lever 38, the drive for the web to pull it off supply rolls, obtained by the combination of rollers 4, 5, must be reestablished.

Figure 7:
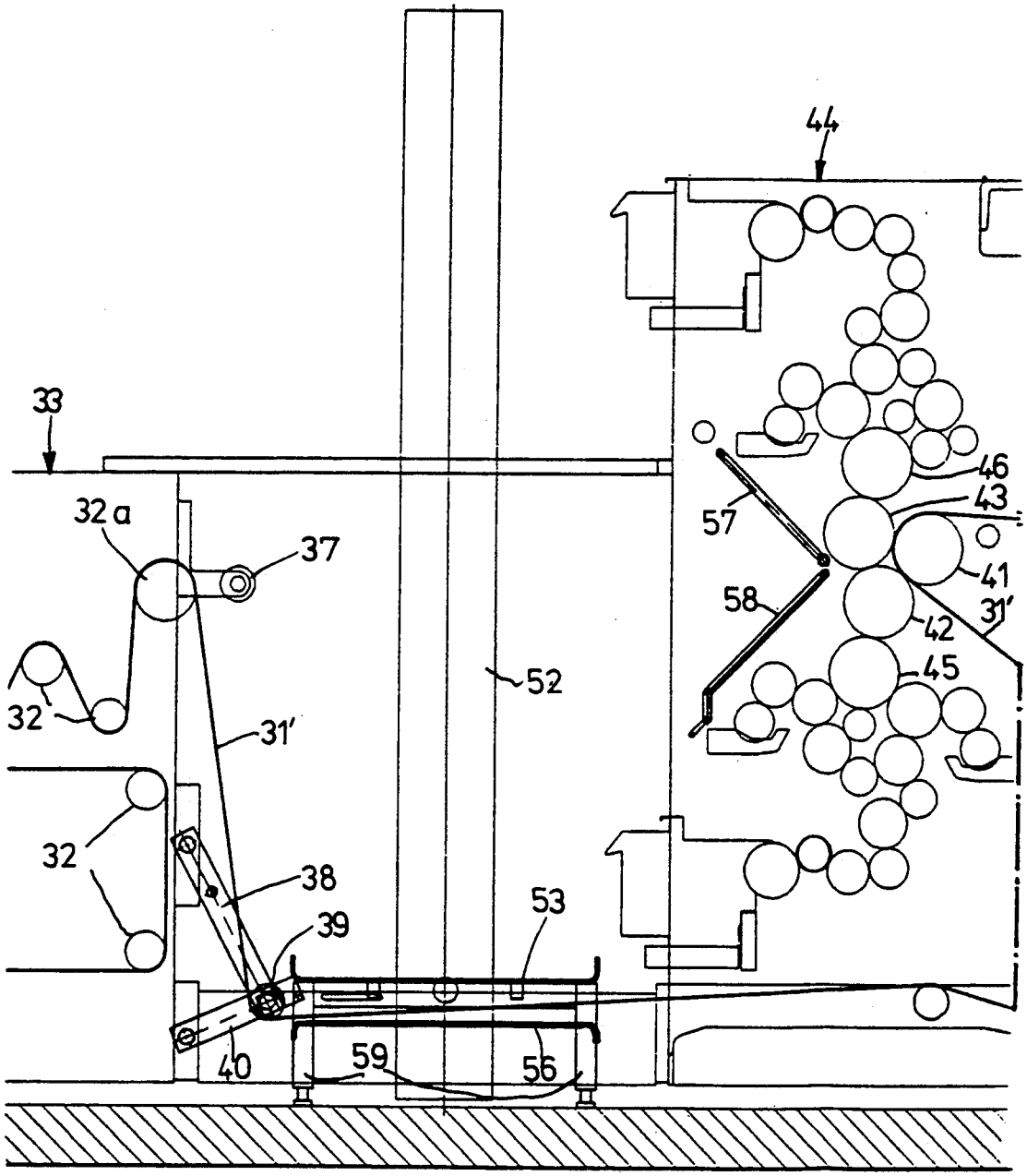
FIG. 7 is a possible arrangement to guide a substrate web through the printing machine unit illustrated in FIG. 3 for, selectively, single or double prime printing.

FIG. 7 illustrates the arrangement of FIGS. 2–5, but arranged for double prime printing, while permitting flying plate change. The web 31', received by the run-in unit 33, is guided downwardly by the last deflection roller 39, located on the pivot lever 38 which is locked in its downward position. The web is now guided, without contact, between the guide elements 53, 56, below the printing station 44, to its other side, by suitable guide rollers, the web path being shown in chain-dotted lines only schematically since this way of placing the web is well known. The web 31' is, by suitable rollers, not shown, guided upwardly and looped about the impression cylinder 41, so that printing can be placed thereon either by a single color from either one of the blanket cylinders 42, 43, with printed subject matter from plate cylinders 42, 46, respectively, or dual color printing, at the same time. The guide roller 39, thus, has a dual function since it forms a guide directing roller to guide the web 31' between the guide elements 53, 56 when they are in their lower position. In this position, also, and since the upper guide element 53 can be walked on, it is readily possible to change the plate on either one of the plate cylinders 45, 46 upon disengagement of the respective plate cylinder from the associated blanket cylinder 42, 43, respectively, for example by suitable eccenters as well known in the printing field. Thus, and upon changing the position of the protective fences 57, 58, flying plate change is possible since either one of the printing couples will be accessible to an operator for retrofitting or maintenance, and especially for change of a printing plate.

The web storage arrangement described and shown having deflection rollers placed as illustrated are a preferred unit; as a general principle, however, any kind of system which stores a predetermined length of web, sufficiently long to permit excursion of the web guide elements from a central or printing position to an upper, or lower position, respectively, can be used. Other types of web storage arrangements are known, for example web storage arrangements positioned between supply roll exchanges and the run-in unit, to maintain web speed constant when rolls are changed. One such unit is described, for example, in the literature reference "Rotary Offset" (Printing), by Oskar Frei.

The web guide element pairs 23, 26 or 53, 56, respectively, are shifted preferably when the cylinders carrying the printed image are thrown off. The web may still be moving, and the main drive can be in an acceleration or braking mode.

Various changes and modifications may be made within the scope of the inventive concept.

We claim:

1. In a rotary printing machine system having a plurality of serially, sequentially positioned operating stations (3, 14, 17, 33, 44) through which a substrate web (1, 31, 31') is guided in an essentially horizontal path between a first operating station and a subsequent operating station, an arrangement for changing the web path in the printing machine system, comprising, in accordance with the invention, a pair of vertically spaced web substrate guide elements (23, 26; 123, 126; 53, 56);

positioning means (22; 122: 52) for selectively movably positioning said pair of guide elements between a printing position in which the substrate web passes between said guide elements without contacting them, and a lower position (23*a*), and an upper position (23*b*);

wherein the upper one (23; 123; 53) of the vertically spaced substrate guide elements is of sufficient strength to support an operator to permit the operator to stand thereon when said substrate guide elements are in their lower position (23*a*) to provide access to an upper region of the operating station, and:

to provide access to the lower region of said operating station when the substrate guide elements are in their upper position (23*b*); and a web storage means (8, 9, 10; 38, 39, 40) to provide substrate web length upon displacement of said substrate guide elements from said printing position.

2. The arrangement of claim 1, wherein said printing machine system has a drive side and an operator side;

and wherein said positioning means are located at the drive side and support said web guide elements in cantilever fashion leaving the operator side unobstructed.

3. The arrangement of claim 2, further including support means (59) extending downwardly from at least the upper one (23; 123; 53) of the web guide elements to support said web guide elements from a support surface when said web guide elements are in the lower position, said support means (59) being located at the operator side of the printing machine system.

4. The arrangement of claim 1, wherein said substrate web guide elements (23, 26; 123, 126; 53, 56) comprise sheet metal elements extending longitudinally and transversely of the substrate web (1, 31, 31'), said sheet metal elements being rounded at least along some of their edges to provide for smooth engagement of said substrate web with a respective web guide element when the pairs of web guide elements are in their upper and lower positions, respectively.

5. The arrangement of claim 1, wherein the individual substrate web guide elements (23, 26; 123, 126; 53, 56) are coupled together to form a unit, said unit being commonly movable between said printing position, said upper position and said lower position.

6. The arrangement of claim 1, wherein said operating station includes a printing station (14);

and wherein said web storage means is located in advance of said printing station.

7. The arrangement of claim 1, wherein said operating station includes at least two sequentially, with respect to the path of travel of the substrate web, positioned printing stations;

and wherein said web storage means (8, 9, 10; 38, 39, 40) is located, with respect to travel of said substrate web, in advance of the first one (14) of said printing stations.

8. The arrangement of claim 1, wherein said operating station includes a substrate web run-in or supply station (3);

and wherein said web storage means comprises a pivot lever (8; 38) pivotably located on a frame of said web supply station (3), a pair of deflection rollers (2*a*, 7; 32*a*, 37) secured to the frame of said web supply station, and laterally, with respect to travel of said substrate web, spaced from each other;

and a deflection roller (9; 39) positioned at an end portion of the pivot lever and pivotably movable between a lower and an upper position to provide for differential lengths of said substrate web (1, 31, 31') when the substrate web is looped about the pivotable roller.

9. The arrangement of claim 1, wherein one of said operating stations comprises a printing unit having printing cylinders arranged to receive said substrate web (31') from a downward position;

wherein said web storage means includes a pivot arm (38) carrying a web deflection roller (39) at an end thereof remote from the pivot point of said pivot arm, said pivot arm placing said web deflection roller at a lowermost position;

and wherein said substrate web (31') is guided about said web deflection roller at its lowermost position, then between said web guide elements (53, 56) located in the lower position, and then upwardly to said printing station.

* * * * *